US009546841B2

(12) United States Patent
Vinci et al.

(10) Patent No.: US 9,546,841 B2
(45) Date of Patent: Jan. 17, 2017

(54) APPARATUS FOR CLEANING FIREARMS

(71) Applicant: Innovative Products of America, Inc., Woodstock, NY (US)

(72) Inventors: Peter Vinci, Shandaken, NY (US); Ian R. Vinci, Shandaken, NY (US); Ryan Estvanik, West Hurley, NY (US)

( * ) Notice: Subject to any disclaimer, the term of this patent is extended or adjusted under 35 U.S.C. 154(b) by 27 days.

(21) Appl. No.: 14/100,179

(22) Filed: Dec. 9, 2013

(65) Prior Publication Data

US 2015/0159973 A1 Jun. 11, 2015

(51) Int. Cl.
*F41A 29/00* (2006.01)
*F41A 29/02* (2006.01)

(52) U.S. Cl.
CPC ..... *F41A 29/02* (2013.01)

(58) Field of Classification Search
CPC ..... F41A 29/00; F41A 29/02
USPC ..... 42/95; 15/211; 403/223, 289, 309, 354, 403/361
See application file for complete search history.

(56) References Cited

U.S. PATENT DOCUMENTS 350,847 A * 10/1886 Sherman ..... 15/104.18
481,858 A * 8/1892 Ferris ..... 15/104.18
1,591,425 A * 7/1926 Kingman ..... A47L 13/225 15/104.16
2,409,916 A 10/1946 Varcoe
2,572,178 A * 10/1951 Monroe et al. ..... 15/154
2,799,883 A * 7/1957 Brady ..... 15/184
2,806,333 A * 9/1957 Head ..... 451/557
3,299,898 A * 1/1967 Payne ..... 131/246
3,716,884 A * 2/1973 Lavins ..... 15/104.16
4,471,507 A * 9/1984 Schwartz ..... 15/176.6
4,547,924 A * 10/1985 Brygider ..... 15/104.16
4,673,376 A * 6/1987 Fender ..... 464/158
4,680,824 A * 7/1987 Lieptz ..... 15/104.165
4,811,445 A * 3/1989 Lagieski et al. ..... 15/104.94
5,211,560 A * 5/1993 Lowder et al. ..... 433/166
5,385,420 A * 1/1995 Newman et al. ..... 403/299
(Continued)

FOREIGN PATENT DOCUMENTS

DE 3838813 A1 * 5/1990 ..... F41A 29/02

OTHER PUBLICATIONS

Definition of "Wad". Random House Kernerman Webster's College Dictionary, © 2010 K Dictionaries Ltd. Copyright 2005, 1997, 1991 by Random House, Inc.*
(Continued)

*Primary Examiner* — Gabriel Klein
(74) *Attorney, Agent, or Firm* — Law Offices of Michael L. Wise, LLC

(57) ABSTRACT

An apparatus for cleaning firearms comprises a rod, a handle, a first cylindrical body portion, a second cylindrical body portion, a stick, and a fiber wad. The handle is attached to an end of the rod. The first cylindrical body portion defines a channel and a longitudinal break in a sidewall of the first cylindrical body portion. The channel and the longitudinal break extend into the first cylindrical body portion from a first end of the first cylindrical body portion, and the longitudinal break at least partially merges with the channel. At the same time, the second cylindrical body portion is attached to a second end of the cylindrical body portion and has a smaller diameter than the first cylindrical body portion. The stick is at least partially inserted into the channel. Lastly, the fiber wad is wrapped around at least a portion of the stick.

17 Claims, 2 Drawing Sheets

(56) References Cited

U.S. PATENT DOCUMENTS

| | | | | |
|---|---|---|---|---|
| 5,934,000 | A * | 8/1999 | Hayes, Sr. | 42/95 |
| 6,029,307 | A * | 2/2000 | Baudoin | 15/145 |
| 6,857,157 | B1 * | 2/2005 | Hoyle | 15/104.05 |
| 7,971,310 | B2 * | 7/2011 | Metaxatos et al. | 15/105 |
| 8,448,370 | B2 * | 5/2013 | Williams | 42/95 |
| 2011/0083354 | A1 * | 4/2011 | Krieger | 42/95 |

OTHER PUBLICATIONS

Definition of "Wrap". American Heritage® Dictionary of the English Language, Fifth Edition. Copyright © 2011 by Houghton Mifflin Harcourt Publishing Company. Published by Houghton Mifflin Harcourt Publishing Company.*

* cited by examiner

APPARATUS FOR CLEANING FIREARMS

FIELD OF THE INVENTION

The present invention relates generally to cleaning arrangements for small arms and ordinance, and, more particularly, to apparatus for cleaning firearms.

BACKGROUND OF THE INVENTION

A barrel of a long gun such as a rifle or shotgun is traditionally cleaned by attaching a solvent-soaked patch to a long cleaning rod and passing the patch through the barrel of the firearm. The patch typically comprises a small square or circular section of cloth. The patch is attached to the cleaning rod by feeding it through a slotted tip attached at one end of the cleaning rod.

Nevertheless, despite their widespread use, conventional cleaning patches are not particularly well suited for cleaning firearms. Conventional cleaning patches, when being passed through a rifled barrel, for example, tend to slide over the lands and grooves of that barrel. This results in residual contamination in the barrel, even after intensive attempts at cleaning Because of the shortcomings of conventional patches for cleaning guns, there has been recent interest in utilizing swabs as an alternative means for cleaning firearms. These swabs consist of fiber wads wrapped around the ends of wooden or plastic sticks. The fiber wads are sized to hold an appropriate amount of solvent and, at the same time, to tightly fit into the barrel of the firearm being cleaned so that the fiber wads contact the entire inner surface of the barrel. At the same time, the swabs are relatively inexpensive, and can be thrown away after just a single use. Nevertheless, while very useful for cleaning handguns with their shorter barrels, a swab would need to have a very long stick length in order to be useful for cleaning long arms. Unfortunately, the sticks used in conventional swabs are typically not of great enough strength to support this kind of extra length. That is, they would be likely to bend and break.

For the foregoing reasons, there is a need for apparatus that allow conventional swabs (with sticks) to be utilized to clean firearms having relatively long barrels.

SUMMARY OF THE INVENTION

Embodiments of the present invention address the above-identified needs by providing novel apparatus for cleaning firearms.

Aspects of the invention are directed to an apparatus for cleaning firearms. The apparatus comprises a first cylindrical body portion and a second cylindrical body portion. The first cylindrical body portion defines a channel and a longitudinal break in a sidewall of the first cylindrical body portion. The channel and the longitudinal break extend into the first cylindrical body portion from a first end of the first cylindrical body portion, and the longitudinal break at least partially merges with the channel. The second cylindrical body portion is attached to a second end of the first cylindrical body portion and has a smaller diameter than the first cylindrical body portion.

Additional aspects of the invention are directed to another apparatus for cleaning firearms, the apparatus comprising a rod, a handle, a first cylindrical body portion, a second cylindrical body portion, a stick, and a fiber wad. The handle is attached to an end of the rod. The first cylindrical body portion defines a channel and a longitudinal break in a sidewall of the first cylindrical body portion. The channel and the longitudinal break extend into the first cylindrical body portion from a first end of the first cylindrical body portion, and the longitudinal break at least partially merges with the channel. At the same time, the second cylindrical body portion is attached to a second end of the first cylindrical body portion and has a smaller diameter than the first cylindrical body portion. The stick is at least partially inserted into the channel. Lastly, the fiber wad is wrapped around at least a portion of the stick.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
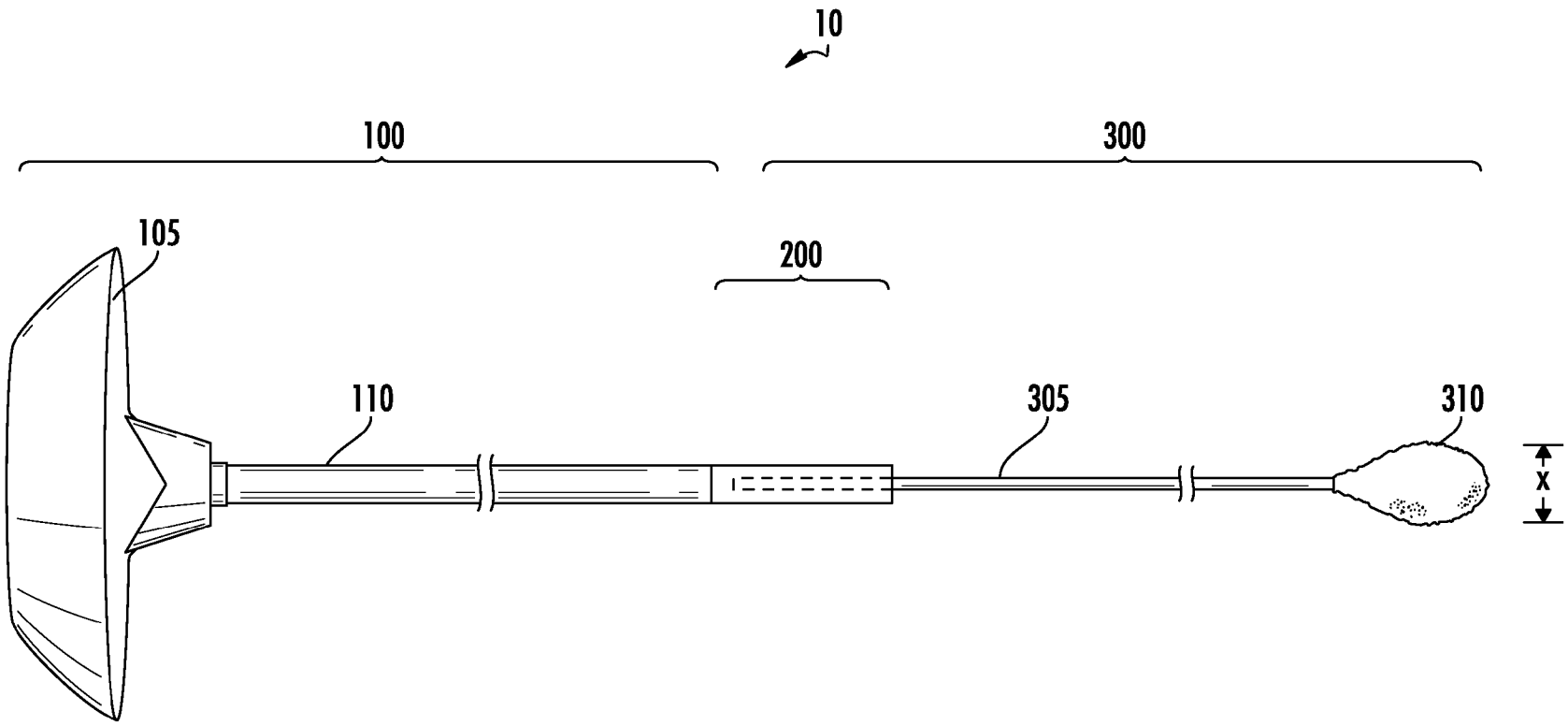
FIG. 1 shows a side perspective view of an apparatus in accordance with an illustrative embodiment of the invention.

FIG. 1 shows a side perspective view of an apparatus 10 in accordance with an illustrative embodiment of the invention. The illustrative apparatus 10 may be conceptually broken down into three portions: a cleaning rod portion 100, an adapter portion 200, and a swab portion 300. When reduced to practice, the apparatus 10 may be utilized to easily and effectively clean the barrel of a long gun such as, but not limited to, a rifle or shotgun.

The cleaning rod portion 100 of the apparatus 10 comprises a handle 105 that is rotatably coupled to a proximal end of a rod 110. The rod 110, in turn, comprises a hollow cylindrical tube. At the distal end of the rod 110, the hollow tube of the rod 110 is preferably internally threaded to accept the adapter portion 200 (detailed below). As used herein, the term "proximal," when describing aspects of the invention, shall mean a position closer to the handle 105 (i.e., towards the left in FIG. 1), while the term "distal" shall mean a position farther away from the handle 105 (i.e., towards the right in FIG. 1).

Figure 2D:
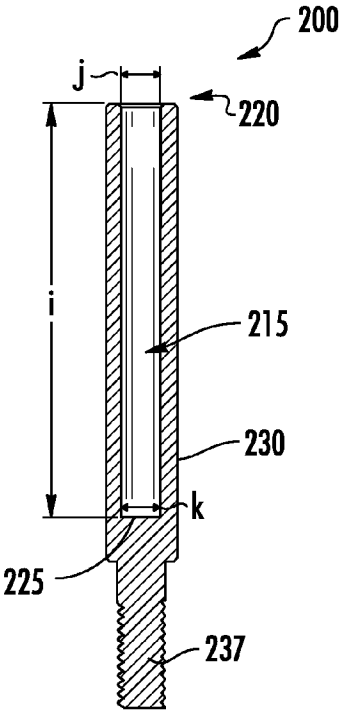
FIG. 2D shows a sectional view of the FIG. 2A adapter.
Figure 2C:
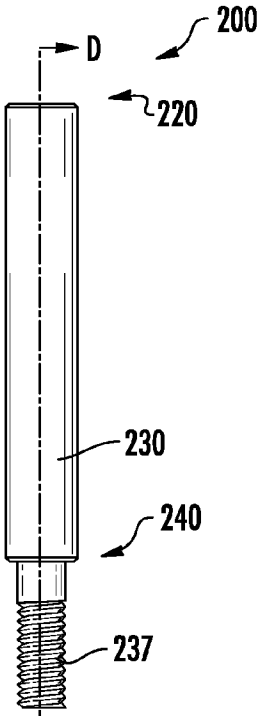
FIG. 2C shows another side elevational view of the FIG. 2A adapter.
Figure 2B:
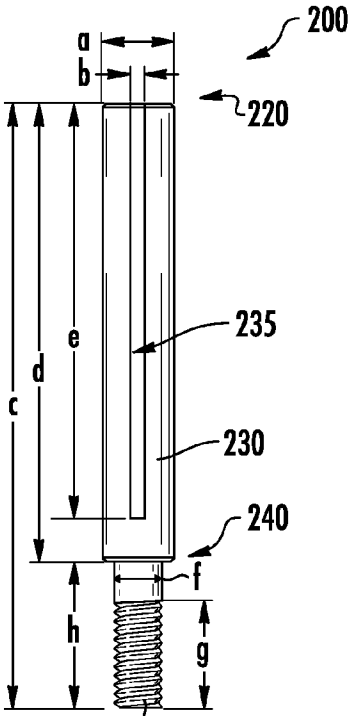
FIG. 2B shows a side elevational view of the FIG. 2A adapter.
Figure 2A:
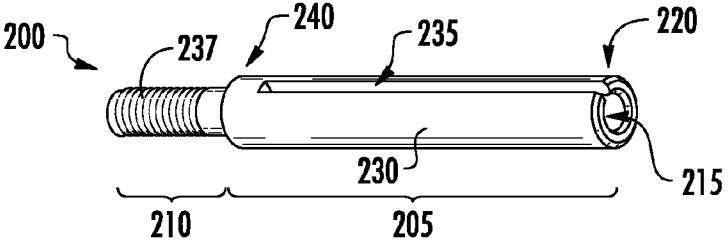
FIG. 2A shows a side perspective view of an adapter in the FIG. 1 apparatus.

Additional details of the adapter portion 200 are shown in FIGS. 2A-2D. FIG. 2A shows a side perspective view of the adapter portion 200; FIG. 2B shows a side elevational view of the adapter portion 200; FIG. 2C shows another side elevational view of the adapter portion 200; and FIG. 2D shows a sectional view of the adapter portion 200 cut along a plane indicated in FIG. 2C.

The illustrative adapter portion 200 can be separated into two sub-portions: a first cylindrical body sub-portion 205 and a second cylindrical body sub-portion 210 (see FIG. 2A). The first cylindrical body sub-portion 205 defines a cylindrical channel 215 therein that extends longitudinally into the first cylindrical body sub-portion 205 from a distal end 220 of the first cylindrical body sub-portion 205. In the present embodiment, this cylindrical channel 215 is somewhat flared outward at the extreme distal end 220 of the first cylindrical body sub-portion 205. The cylindrical channel 215, moreover, is tapered, meaning that it has a larger diameter at its distal end (coinciding with the distal end 220 of the first cylindrical body sub-portion 205) than it does at a proximal end 225 (visible in FIG. 2D). At the same time, a sidewall 230 of the first cylindrical body sub-portion 200 defines a break 235, which follows the cylindrical channel 215 from the distal end 220 of the first cylindrical body sub-portion 205 for the entire length of the cylindrical channel 215. This break 235 merges with the cylindrical channel 215.

The second cylindrical body sub-portion 210 is attached to a proximal end 240 of the first cylindrical body sub-portion 205 and has a smaller diameter than the first cylindrical body sub-portion 205. In accordance with aspects of the invention, the second cylindrical body sub-portion 210 defines external threads 237, which are complementary to the internal threads at the distal end of the rod 110, thereby allowing the adapter portion 200 to be screwably attached to the rod 110.

Again referring to FIG. 1, the swab portion 300 comprises a stick 305 with a proximal end that is partially inserted into the adapter portion 200. A fiber wad 310 is wrapped around the distal end of the stick 305. As further detailed below, the stick 305 preferably has a diameter slightly larger than the average diameter of the cylindrical channel 215. At the same time, the break 235 in the sidewall 230 of the adapter portion 200 allows the cylindrical channel 215 to expand somewhat when the stick 305 is inserted therein. Accordingly, once partially inserted into the cylindrical channel 215 (as shown in FIG. 1), the adapter portion 200 exerts a compressive force on the stick 305, which helps to fixate the stick 305 in the channel 215. The stick 305 thereby becomes manually removably attachable to the first cylindrical body sub-portion 205. As used herein, the term "manually removably attachable" means attachable and removable by a human being of average strength utilizing only that human being's hands without tools.

In the apparatus 10, the cleaning rod 110 is substantially conventional. The handle 105 may, for example, comprise plastic (e.g., nylon), while the rod 110 comprises a metal (e.g., steel or aluminum) or plastic (e.g., nylon). In one or more non-limiting embodiments, the rod 110 may have a length of about 24 to about 36 inches and a diameter of about 0.2 inches. However, these dimensional values, like all the values set forth in this Section, are merely illustrative and should not be construed as limiting the scope of the invention.

The adapter portion 200 preferably comprises a somewhat elastic plastic (e.g., nylon). This elasticity, in combination with the other design aspects of the adapter portion 200, allows the adapter portion 200 to manually removably attach to a stick having a diameter larger than at least a portion of the cylindrical channel 215, as described above. Table I shows some illustrative dimensions for two non-limiting embodiments of the adapter portion 200. In this Table, Embodiment A may, for example, be well suited to cleaning a rifle, while Embodiment B may be well suited to cleaning a shotgun, the shotgun having a larger diameter barrel than the rifle.

TABLE I

Illustrative dimensions for two embodiments of the adapter portion 200 (referenced to FIGS. 2B-2D)

| | Embodiment A (inches) | Embodiment B (inches) |
|---|---|---|
| a | 0.188 diameter | 0.250 diameter |
| b | 0.010 | 0.050 |
| c | 1.63 | 2.09 |
| d | 1.13 | 1.59 |
| e | 1.00 | 1.44 |
| f | 0.163 diameter | |
| g | 0.375 | |
| h | 0.500 | |
| i | 1.00 | 1.44 |
| j | 0.093 diameter | 0.133 diameter |
| k | 0.085 diameter | 0.125 diameter |

It will be noted that, in Embodiment A, the cylindrical channel 215 gradually tapers from 0.093 inches just below the flared region near the distal end 220 of the first cylindrical body sub-portion 205 to 0.085 inches at its proximal end 225 (a reduction of about 9% along a majority of the length of the cylindrical channel 215). In Embodiment B, the cylindrical channel 215 gradually tapers from 0.133 inches to 0.125 inches (a reduction of about 6%). At the same time, the second cylindrical body portions 210 in both Embodiment A and Embodiment B have like dimensions so that both of their respective adapter portions 200 can be attached to a common cleaning rod 110. In one or more embodiments, the internal threads of the rod 110 and the external threads 237 of the second cylindrical body sub-portion 210 may correspond to 8-32 UNC (Coarse) in accordance with the Unified Thread Standard.

In one or more embodiments, the stick 305 of the swab portion 300 may comprise wood, plastic, or bamboo, while the fiber wad 310 may comprise cotton or a synthetic fiber. As indicated above, the diameter of the stick 305 is preferably slightly larger than the average diameter of the cylindrical channel 215 of the adapter portion 200. Sticks with diameters of 0.098 inches and 0.138 inches were successfully utilized with prototypes of adapter portions 200 having dimensions corresponding to Embodiment A and Embodiment B, respectively, set forth in Table I. In both cases, the sticks were solidly fixated to the adapter portions 200 when partially inserted therein, but were still removable by hand with the exertion of average strength and without the assistance of tools.

The fiber wad 310 at the end of the stick 305 preferably has a maximum diameter (labeled as x on FIG. 1) that is slightly larger than the diameter of the barrel being cleaned. Thus different swab portions will preferably be utilized with different calibers of firearms. Having the fiber wad 310 have a slightly larger diameter ensures that the fiber wad 310 will compress somewhat when entering the barrel and thereby exert some expansive force on the inside of the barrel while cleaning This will cause the fiber wad 310 to effectively scrub the inner surface of the barrel, and will also assure that the fiber wad 310 will conform to any lands and grooves associated with a rifled barrel.

With the apparatus 10 assembled as shown in FIG. 1, the fiber wad 310 may be dipped into an appropriate cleaning solvent and then passed through the barrel of a firearm to clean the inside of that barrel. The swab portion 300 may then be manually removed from the adapter portion 200 and a new swab portion 300 utilized as desired to complete the cleaning. The swab portion 300 may thereby be disposable (i.e., single use). Because of the extended length provided by the cleaning rod 110, a swab portion with only a relatively short stick 305 may thereby be utilized to clean the barrel of a long gun. In fact, swab portions 300 with stick lengths designed for handguns (e.g., eight inches) may be easily utilized to clean long guns. With the reduced stick length, there is far less danger that the stick 305 will bend and break during cleaning, and any issues associated with "jammed" fiber wads 310 will be avoided.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus for cleaning firearms, the apparatus comprising:

a first cylindrical body portion, the first cylindrical body portion comprising a channel with a sidewall and a longitudinal break in the sidewall, the channel and the longitudinal break both extending into the first cylindrical body portion from a first end of the first cylindrical body portion, and the longitudinal break at least partially merging with the channel;

a second cylindrical body portion, the second cylindrical body portion being immovably attached to a second end of the first cylindrical body portion and having a smaller diameter than the first cylindrical body portion;

a stick, the stick at least partially inserted into the channel; and a bulbous fiber wad, the bulbous fiber wad directly wrapped around a length of the stick and disposed in spaced relation to the first cylindrical body portion;

wherein the sidewall gradually thickens to cause the channel to gradually taper along a majority of the channel's length.

2. The apparatus of claim 1, wherein the channel is substantially cylindrical.

3. The apparatus of claim 1, further comprising a rod, the rod attached to the second cylindrical body portion.

4. The apparatus of claim 3, wherein the apparatus further comprises a handle, the handle attached to an end of the rod.

5. The apparatus of claim 4, wherein the handle is rotatably coupled to the end of the rod.

6. The apparatus of claim 3, wherein at least a portion of the second cylindrical body portion defines external threads thereon.

7. The apparatus of claim 6, wherein the second cylindrical body portion is attached to the rod at least in part utilizing the external threads.

8. The apparatus of claim 1, wherein the stick is manually removably attached to the first cylindrical body portion.

9. The apparatus of claim 1, wherein the first cylindrical body portion exerts a compressive force on at least a portion of the stick.

10. The apparatus of claim 1, wherein the stick has a larger diameter than an average diameter of the channel.

11. The apparatus of claim 1, wherein the stick comprises wood or plastic.

12. The apparatus of claim 1, wherein the stick comprises bamboo.

13. The apparatus of claim 1, wherein the bulbous fiber wad comprises at least one of cotton and synthetic fiber.

14. An apparatus for cleaning firearms, the apparatus comprising:

a rod;

a handle; the handle attached to an end of the rod;

a first cylindrical body portion, the first cylindrical body portion comprising a channel with a sidewall and a longitudinal break in the sidewall, the channel and the longitudinal break both extending into the first cylindrical body portion from a first end of the first cylindrical body portion, and the longitudinal break at least partially merging with the channel;

a second cylindrical body portion, the second cylindrical body portion being immovably attached to a second end of the first cylindrical body portion, and having a smaller diameter than the first cylindrical body portion;

a stick, the stick at least partially inserted into the channel; and a bulbous fiber wad, the bulbous fiber wad directly wrapped around a length of the stick and disposed in spaced relation to the first cylindrical body portion;

wherein the sidewall gradually thickens to cause the channel to gradually taper along a majority of the channel's length;

wherein at least a portion of the second cylindrical body portion defines external threads thereon, and the second cylindrical body portion is attached to the rod at least in part utilizing the external threads.

15. The apparatus of claim 14, wherein the stick is manually removably attached to the first cylindrical body portion.

16. The apparatus of claim 14, wherein the first cylindrical body portion exerts a compressive force on at least a portion of the stick.

17. A kit for cleaning firearms, the kit comprising:

a first cylindrical body portion, the first cylindrical body portion comprising a channel with a sidewall and a longitudinal break in the sidewall, the channel and the longitudinal break both extending into the first cylindrical body portion from a first end of the first cylindrical body portion, and the longitudinal break at least partially merging with the channel;

a second cylindrical body portion, the second cylindrical body portion being immovably attached to a second end of the first cylindrical body portion and having a smaller diameter than the first cylindrical body portion;

a stick; and a bulbous fiber wad, the bulbous fiber wad directly wrapped around a length of the stick;

wherein the sidewall gradually thickens to cause the channel to gradually taper along a majority of the channel's length;

wherein the stick is insertable into the channel with the bulbous fiber wad disposed in spaced relation to the first cylindrical body portion.

* * * * *